US006029858A

United States Patent [19]

Srokose et al.

[11] Patent Number: 6,029,858

[45] Date of Patent: Feb. 29, 2000

[54] JUG AND METHOD

[76] Inventors: John S. Srokose, 19600 E. Lake Dr., Miami, Fla. 33015; Lyndley A. Williams, 3012 Dolphin Dr., Miramar, Fla. 33025

[21] Appl. No.: 09/070,989

[22] Filed: May 1, 1998

[51] Int. Cl.[7] ..... B67D 5/60; A47G 19/00

[52] U.S. Cl. ..... 222/143; 222/465.1; 222/468

[58] Field of Search ..... 222/143, 468, 222/465.1; 206/509

[56] References Cited

U.S. PATENT DOCUMENTS 4,804,119 2/1989 Goodall ..... 222/468

*Primary Examiner*—Steven O. Douglas
*Assistant Examiner*—Peter deVore

[57] ABSTRACT

A jerry jug in which the assembly of the handle and the neck traverse essentially from one side to the other of the top. The neck is provided with a breather ring which is positioned between the cap mount portion and flow control tube in such a fashion that the same are in open communication with the interior portion of the handle. The handle terminates at one end with the vent to the breather ring and at the other end with the vent to the body. By eliminating a vent at the rear end of the handle, the undercut for the handle can be widened to accommodate the larger hands of tradesmen and even permit two such containers to be easily held in one hand. The bottom of the unit is provided with a pair of spaced feet, distanced apart to straddle the handle and neck of an adjacent upper or lower jerry jug thereby permitting stacking the same. The rear foot assists in pouring. The method is directed to diverting air from a breather ring on the inside portion of a bottle neck through a hollow handle to a remote corner of the jerry jug. The remote portion is at the intersection at the top and the back wall.

11 Claims, 4 Drawing Sheets

JUG AND METHOD

FIELD OF THE INVENTION

The field of this invention relates to blow molded type containers or bottles. More specifically it relates to that type construction known as a Jerry Jug. By definition, a jerry jug is a miniature version of a jerry can of the type which became famous in World War II strapped on Jeeps and elsewhere on mobile equipment.

BACKGROUND OF THE INVENTION

The typical jerry jug is basically a cube with a handle at the top and a pouring spout at one end and a removable vent at the other end of the top. Two and one half gallon sizes are common place, particularly when used to house chlorine for the treating of swimming pools.

A major problem with any dispensing containers, whether reusable for outdoor lawnmowers, outboard motors, spare fuel to carry in the trunk of a car, or a myriad of other purposes is that they normally require separate vents with a separate vent cap. This creates a problem as to a part which can be lost. Necessarily the cap of the bottle needs to be removed as well. However, it is known in the art how to strap a cap to a container so that it will not readily be disengaged.

What is really required, however, is to develop a jerry jug of the type currently employed which is user friendly, which is easy to handle, and which is self-venting and requires but a single cap.

Further household examples of the prior art include Clorox® bleach bottles, Whisk® bottles and concentrated soap bottles. Invariably in these structures, the handle is either angled upwardly or vertical. Because of the nature of blow molding, the handles are hollow. Attempts have been made to connect the handle with an area at the spout with various inserts to provide for venting. As to the inserts, they can become dislodged, or disoriented in use. Furthermore, they impede the rapid flow of the contents through the bottle neck. Additionally, with the Clorox® type bypass, a crescent-shaped wier is created adjacent the intersection of the neck with the upper portion of the handle. The wier, of course, restricts the flow and creates a venturi effect, the opposite of what is desired. In addition, with the inserts, there is the additional labor and cost of molding the insert and then filling the container, and thereafter positioning the insert. As a consequence, based upon the direct prior art of a jerry jug described above, and the household usages, what is desirable is a self-venting jerry jug with no extra parts, one which will pour freely, one which maximizes the opening of the handle portion, and one which is stackable. It should be noted as to the Clorox® bleach, Whisk®, and other household items, they all suffer the disability of not being stackable.

SUMMARY OF THE INVENTION

The present invention is directed to a jerry jug in which the assembly of the handle and the neck traverse essentially from one side to the other of the top. The neck is provided with a breather ring which is positioned between the cap mount portion and flow control tube in such a fashion that the same are in open communication with the interior portion of the handle. The handle terminates at one end with the vent to the breather ring and at the other end with the vent to the body. By eliminating a vent at the rear end of the handle, the undercut for the handle can be widened to accommodate the larger hands of tradesmen and even permit two such containers to be easily held in one hand. The bottom of the unit is provided with a pair of spaced feet, distanced apart to straddle the handle and neck of an adjacent upper or lower jerry jug thereby permitting stacking the same. The rear foot assists in pouring. A child proof, tamper proof type 63 mm cap available for safe use can be readily secured to the threads at the top of the bottle neck. Optionally, a retainer strap can be secured to the cap and to the bottle neck to prevent the one from being disengaged by the other. The method is directed to diverting air from a breather ring on the inside portion of a bottle neck through a hollow handle to a remote corner of the jerry jug. The remote portion is at the intersection at the top and the back wall. Necessarily when pouring, the vented portion of the handle leading to the back is remote from any fluid contained in the jerry jug, but the fluid flowing out of the jerry jug is provided with a breather ring which perm its the handle interior portion to breath and relieve the reduction of pressure inside the jerry jug as fluid is dispensed.

In view of the foregoing it is a principle object of the present invention to provide a jerry jug which is self-venting and does not have an exposed reclosable vent to the jug portion itself.

A further object of the present invention is to provide a jerry jug which in essence is ventless from a standpoint of an exterior vent, but which will breath readily in order to permit easy flow of the fluid contained therein.

Yet another object of the present invention is to provide such a jerry jug economically where the elimination of the second removable breather cap is a trade-off with the complexity of the molding.

Yet another important object of the present invention is to provide a jerry jug with a handle having a maximized undercut portion to accommodate larger hands and to permit the hand to pass therethrough in order to carry another jerry jug in the one hand, particularly when the two are empty and being collected for further use.

ILLUSTRATIVE DRAWINGS

Further objects and advantages of the present invention become apparent as the following description of the illustrative drawings proceeds, taken in conjunction with the accompanying drawings as follows:

FIG. 1*a* discloses a typical prior art jerry jug utilizing a cap at one end of the handle portion and a vent cap at the other;

FIG. 1*b* illustrates the type of insert utilized in containers for dispensing liquid detergents;

FIG. 1*c* illustrates the neck portion of a bleach bottle in which there is a vent to the pouring opening through the handle.

DESCRIPTION OF THE PREFERRED EMBODIMENTS

Figure 1D:
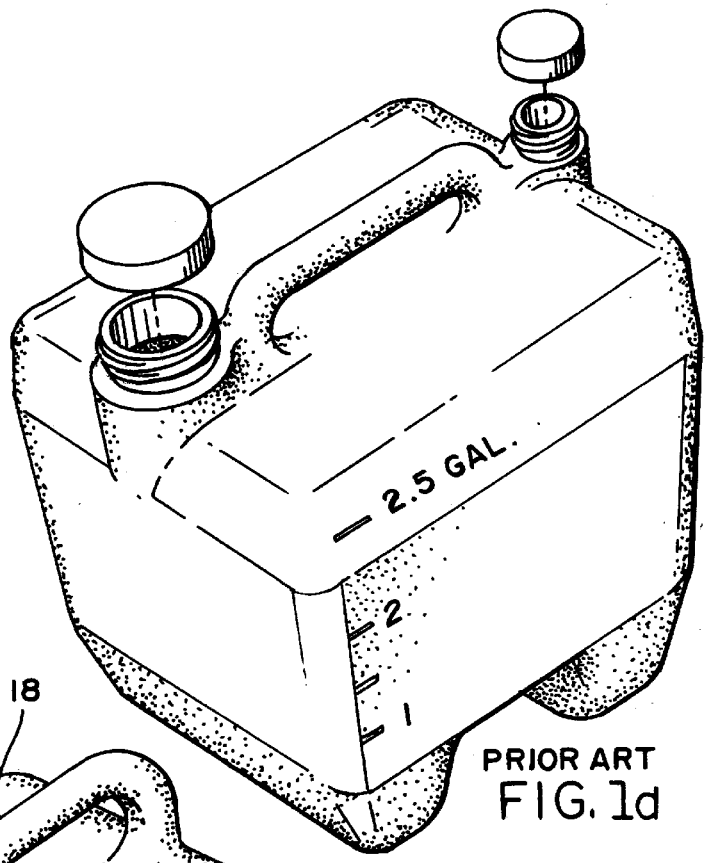
PRIOR ART FIG. 1d
Figure 1B:
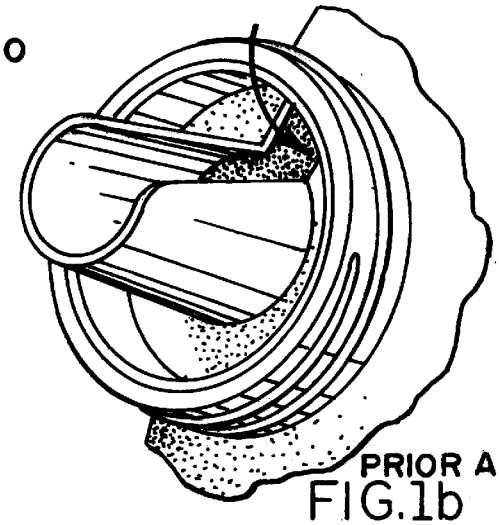
PRIOR ART FIG.1b
Figure 1C:
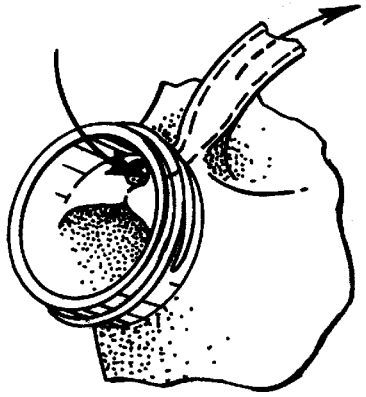
PRIOR ART FIG.1c

As noted in the drawings, FIG. 1 shows a typical prior art jerry jug. It will be seen that it has a handle, a pouring neck and a vent release cap at opposite ends of the handle from the pouring neck and cap. It should be observed that the pouring neck is relatively small in diameter and that the provision for the venting cap and assembly reduces the potential opening beneath the handle to restrict carry to a smaller grip, primarily by finger rather than by the full hand.

Figure 2:
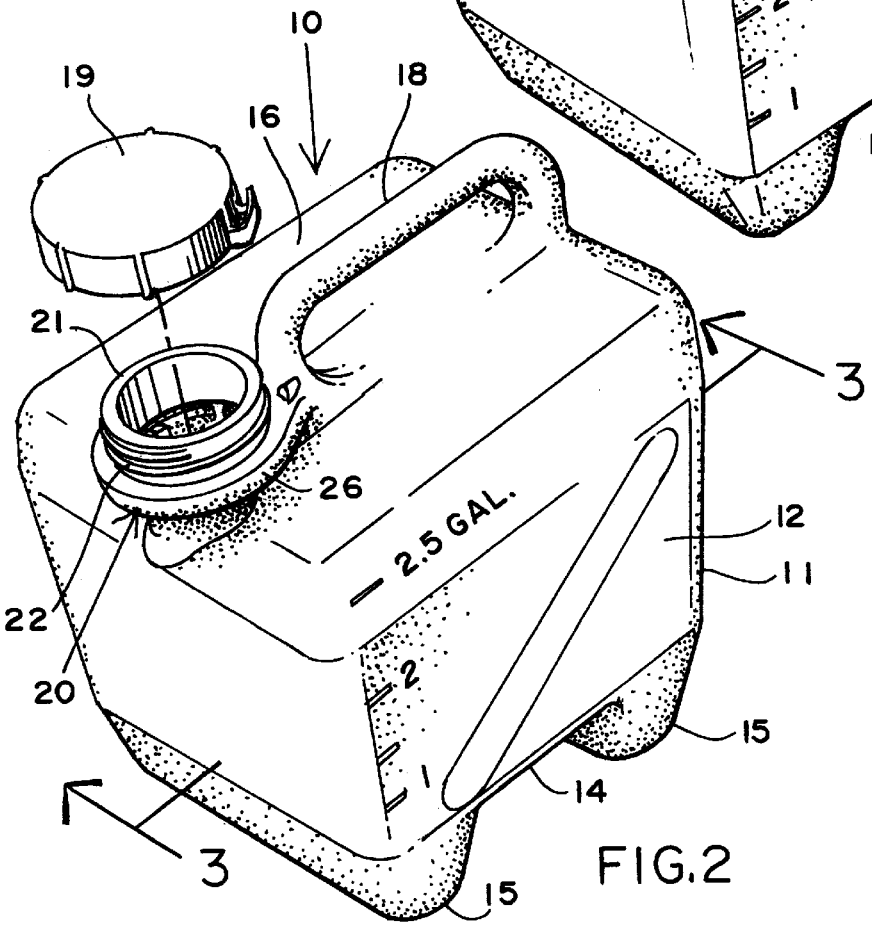
FIG. 2 is a view comparable in size and location of a ventless jerry jug illustrative of the present invention.
Figure 8:
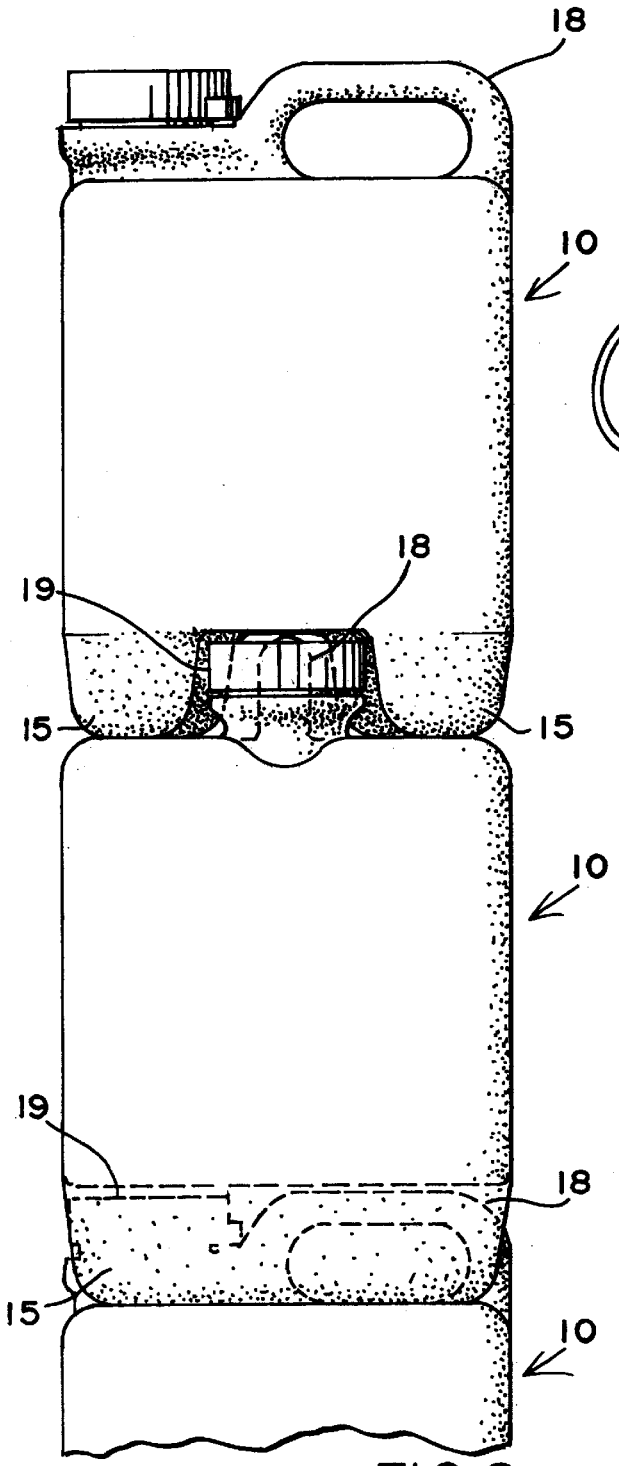
FIG. 8 is an end view of a plurality of the subject jerry jugs while stacked.

Illustrative of the invention is the jerry jug 10 illustrated in FIG. 2. There will be seen that the illustrative jerry jug 10 contains the traditional body 11, which body has side walls 12 and a bottom 14. The bottom 14, in turn, is provided with spaced feet 15, the function of which will become apparent hereinafter.

The top 16 of the jerry jug 10 is provided with a hollow handle 18. The hollow handle 18 has a cap at one end and a large grip area beneath the handle 18 and the top 16 of the jerry jug 10. One end 28 of the hollow handle 18 vents to the breather ring 26 and the other end 29 of the hollow handle 18 vents to the body.

A bottle neck 20 is provided adjacent the handle which blends in with the hollow handle extending all the way across the top to be shaped onwardly to communicate with the interior portion of the body 11. More specifically, the bottle neck 20 is provided with a cap mount 21 and cap mount threads 22. The cap mount threads are intended for use with a cap 19, preferably of the child proof type which requires a pressure downwardly in order to open same.

Figure 3:
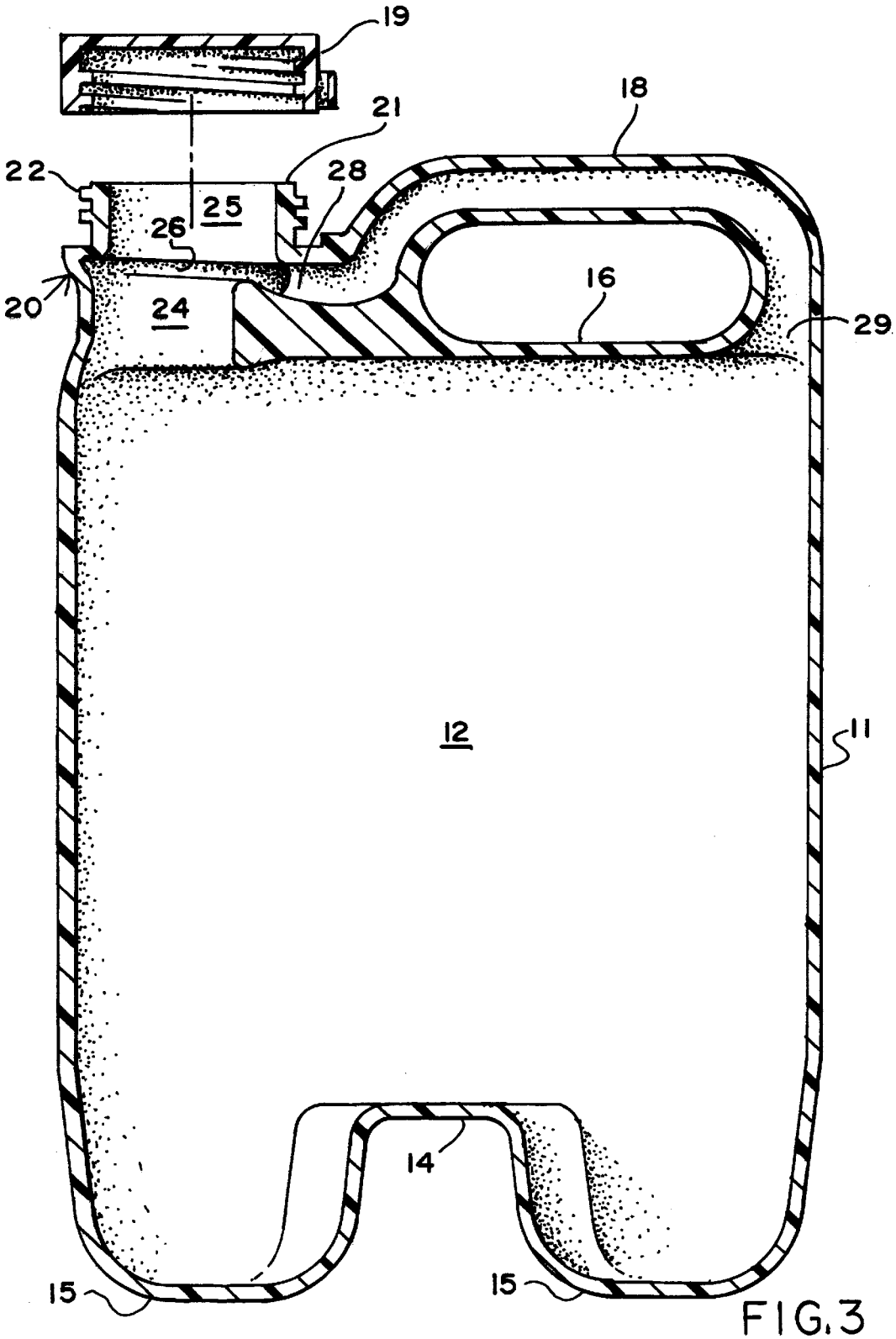
FIG. 3 is a longitudinal transverse view cut-away through the middle of the handle of the jerry jug illustrative of the present invention.
Figures 4, 5, 6, 7:
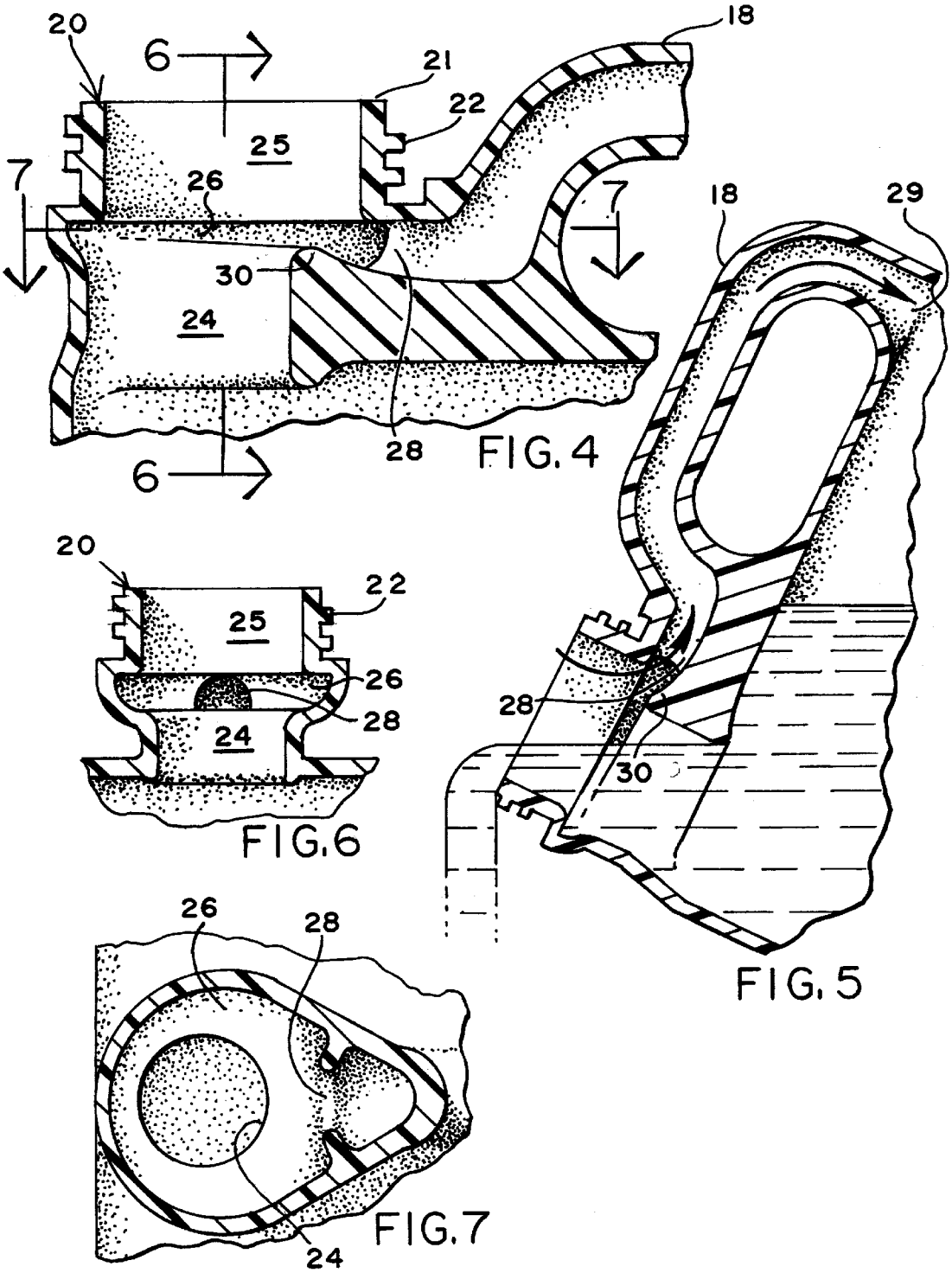
FIG. 4 is an enlarged view of the transverse portion of the jerry jug at the neck area and showing the breather ring.
FIG. 5 is an enlarged view of the upper portion of the jerry jug illustrating how the fluid behaves while pouring.
FIG. 6 is a transverse enlarged sectional view through the neck showing the breather ring, flow control and cap engaging threading portion.
FIG. 7 is a horizontal section of the neck illustrating the breather ring and its connection to the open handle.

As noted in FIGS. 3 and 4, the flow control tube 24 is at the bottom of the neck, with a pouring spout 25 at the top. The breather ring 26 is in between the control tube 24 and the pouring spout 25.

More specifically, as shown in FIGS. 4, 5, 6 and 7, which are transverse sections of the neck, the breather ring 26 is provided interiorly of the neck 20 which assists in promoting turbulence of the fluid and at the same time pneumatically communicating with the interior portion of the hollow handle to thereby permit air to enter inside the body 11 to relieve any vacuum that is caused by the removal of the fluid. Also, as shown in FIG. 3, the pouring tube spout 25 is larger in diameter than the flow control tube 24 and they are not concentric. This eccentric relationship provides a relief from any venturi effect since a crescent-shaped vented area 30 is provided at the fluid exit from the neck 20.

While dimensions are not critical to the subject invention, it is illustrated in a preferred commercial form with a 2½ gallon capacity as approximately 8½×8½ inches square, formed of polypropylene, and weight 670 grams±10 grams. The interior diameter of the flow control tube 24 is 1.43 inches±1/32 inch, and the top of the neck is proportioned to fit a typical 63 mm. child resistant and senior friendly cap. The interior diameter of the breather ring 26 is 2.3 inches±1/32 inch. Other suitable materials for molding the jerry jug 10 are polypropylene, PVC, or PET. Polyproylene is preferred due to its strength. In a 1 gallon version, the dimensions are 6½×7 inches, 8 inches heigh, preferably a 45 mm safety cap is employed to give approximately the same distance under the handle as with the 2½ gallon unit.

The Method

The method of the present invention relates to providing a jerry jug 10 with a "ventless" construction. By "ventless", it is meant that the same is vented but not by means of a secondary opening at the outside portion of the jerry jug 10 but rather internally. The method relates to providing a communication between the neck 20 of the jerry jug 10 through the hollow handle 18 to thereby permit air, as the fluid content is being dispensed, to pass through the interior portion to vent the same.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A jug comprising, in combination, a body having side walls, a bottom and a top;

a bottle neck on the top of the jug;

a handle portion, hollow in nature extending across the major portion of the top of the jug body, and having an end in open communication with the bottle neck and the other end in open communication with the interior of the body remote from the neck;

a breather ring interiorly of the bottle neck having means for diverting air to pass through the hollow handle into the interior portion of the body;

a flow control tube having a diameter smaller than the bottle neck I.D. and positioned with the flow control tube axis parallelly spaced and substantially offset from the axis of the bottle neck;

the cross-sectional area of said flow control tube being less than that of the bottle neck whereby the fluid is initially controlled in its flow by the control tube and sufficient space provided in the downstream direction of pouring for the fluid to avoid contact with the hollow handle.

2. In the jug according to claim 1, said control tube being axially spaced from the bottle neck axis in a direction away from the hollow handle, all in such relationship that the control tube is as close to the sidewall as practicable.

3. In the jug according to claim 2, said cross-sectional area relationship of the I.D. of the control tube to the breather ring I.D. is in the range of 50% to 100%.

4. In the jug according to claim 3, said flow control tube being eccentric in with the pouring spout thereby defining a crescent-shaped relief area in the neck leading to ambient.

5. In the jug according to claim 1, said cross-sectional area relationship of the I.D. of the control tube to the bottle neck I.D. is in the range of 50% to 100%.

6. The method of forming a jug having a body, said body having side walls, a top, a bottom, a handle and a bottle neck having cap engaging means at the upper portions comprising the steps of:

forming said handle to be hollow from one end to the other, parallel with the top, and in open communication at one end to the body, and in open communication at the other end to the bottle neck;

providing the bottle neck with a breather ring beneath the cap engaging means to vent to the handle;

providing a control tube having an axis parallel with that of the bottle neck but offset therefrom in a direction away from the hollow handle; and proportioning the bottle neck to have a larger cross-sectional area than the control tube.

7. The method of forming a jug, according to claim 5, including the step of:

forming said handle to be hollow from one end to the other and in open communication at one end to the body, and in open communication at the other end to the bottle neck breather ring.

8. In the method according to claim 6, proportioning the handle hollow portion to engage the near portion of the control tube in a relationship overlying the same in part.

9. A jug comprising, in combination, a body having side walls, a bottom, and a top;

a handle portion, hollow in the interior, extending across the major portion of the top of the jug body;

a bottle neck in open communication with the interior portion of the handle and the exterior portion of the jug;

a flow control tube formed in open communication with the bottle neck and having an axis parallel to that of the axis of the bottle neck;

said flow control tube having a diameter smaller than the bottle neck and positioned opposite and substantially axially offset from the bottle neck with a breather ring between the bottle neck and the flow control tube;

said flow control tube having a diameter substantially one half that of the breather ring, and less than that of the bottle neck.

10. In the jug according to claim 9, said flow control tube overlapping a portion of the breather handle; whereby the initial and ongoing tendency of the jug when emptied from full capacity to "glug" is minimized.

11. A jug comprising, in combination, a body having side walls, a bottom and a top;

a bottle neck on the top of the jug;

a handle portion, hollow in nature extending across the major portion of the top of the jug body, and having an end in open communication with the bottle neck and the other end in open communication with the interior of the body remote from the neck;

a breather ring interiorly of the bottle neck having means for diverting air to pass through the hollow handle into the interior portion of the body;

a flow control tube having a diameter smaller than the bottle neck I.D. and positioned paraxially spaced from the bottle neck;

the cross-sectional area of said flow control tube being less than that of the cross-section area of the bottle neck whereby the fluid is initially controlled in its flow by the control tube and sufficient space provided in the downstream direction of pouring for the fluid to avoid contact with the hollow handle;

said control tube being axially spaced from the bottle neck axis, all in such relationship that the control tube is as close to the sidewall as practicable;

said cross-sectional area relationship of the I.D. of the control tube to the breather ring I.D. is in the range of 50% to 100%; and said flow control being eccentric in with the pouring spout thereby defining a crescent-shaped relief area in the neck leading to ambient.

* * * * *